United States Patent [19]

Richardson et al.

[11] Patent Number: 4,747,396

[45] Date of Patent: May 31, 1988

[54] ANTI-CHOKE RELEASER

[76] Inventors: Samuel J. Richardson, 404 Griffith Rd., Monroe, N.C. 28110; George Spector, 233 Broadway RM 3815, New York, N.Y. 10007

[21] Appl. No.: 936,096

[22] Filed: Nov. 28, 1986

[51] Int. Cl.[4] ..... A61H 23/00; A61H 23/06

[52] U.S. Cl. ..... 128/54; 128/67

[58] Field of Search ..... 128/54, 60, 61, 67, 128/59, 28; 173/119, 120, 13; 124/37, 26, 16, 361

[56] References Cited

U.S. PATENT DOCUMENTS

| | | | |
|---|---|---|---|
| 2,970,592 | 2/1961 | David | 128/69 |
| 3,108,395 | 10/1963 | Goldfarb | 124/26 |
| 3,228,392 | 1/1966 | Speyer | 128/60 |
| 3,744,484 | 7/1973 | LaTorraca | 128/54 |
| 4,116,235 | 9/1978 | Fahr et al. | 128/69 |
| 4,164,216 | 8/1979 | Person | 128/54 |

*Primary Examiner*—Edgar S. Burr
*Assistant Examiner*—Tonya Lamb

[57] ABSTRACT

An anti-choke releaser apparatus is provided and consists of a spring activated mechanism that is anchored to a flat vertical surface and which will apply a sharp blow to the upper abdomen to aid in the expulsion of an obstruction from the larynx of a choking victim. In a modification the apparatus is in the shape of a gun which can be easily held in the hand and contains a piston that is activated by a trigger releasing gas from a carbon dioxide cartridge to fire the piston having an impact plate into the upper abdomen.

4 Claims, 1 Drawing Sheet

ANTI-CHOKE RELEASER

BACKGROUND OF THE INVENTION

The instant invention relates generally to physical impact devices and more specifically it relates to an anti-choke releaser apparatus.

Numerous physical impact devices have been provided in prior art that are adapted to supply controlled blows to preselected areas of the body. For example, U.S. Pat. Nos. 2,970,592; 3,744,484 and 4,164,216 all are illustrative of such prior art. While these units may be suitable for the particular purpose to which they address, they would not be as suitable for the purposes of the present invention as heretofore described.

SUMMARY OF THE INVENTION

A primary object of the present invention is to provide an anti-choke releaser apparatus that will overcome the shortcomings of the prior art devices.

Another object is to provide an anti-choke releaser apparatus that will apply a sharp blow to the upper abdomen to aid in the expulsion of an obstruction from the larynx of a choking victim.

An additional object is to provide an anti-choke releaser apparatus being in the shape of a gun so as to be easily held in the hand to apply the sharp blow to the upper abdomen.

A further object is to provide an anti-choke releaser apparatus that is simple and easy to use.

A still further object is to provide an anti-choke releaser apparatus that is economical in cost to manufacture Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
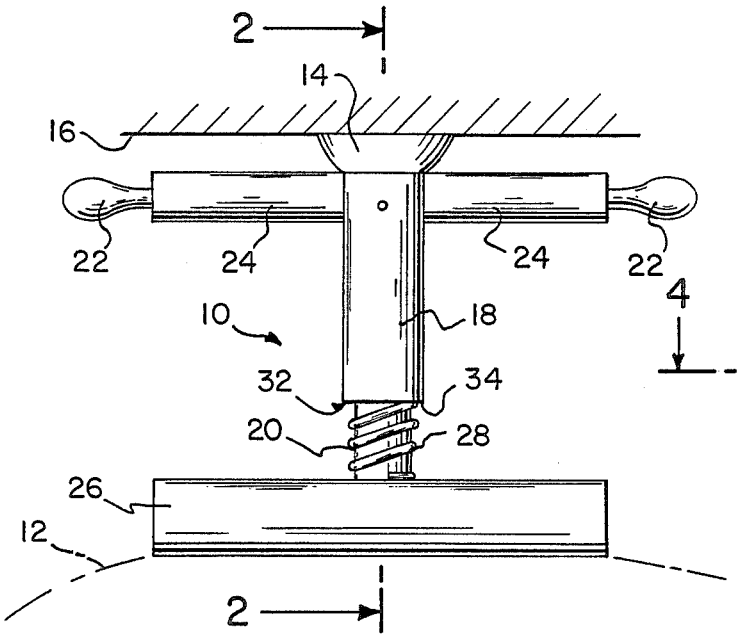
FIG. 1 is an elevational view of the invention.
Figure 2:
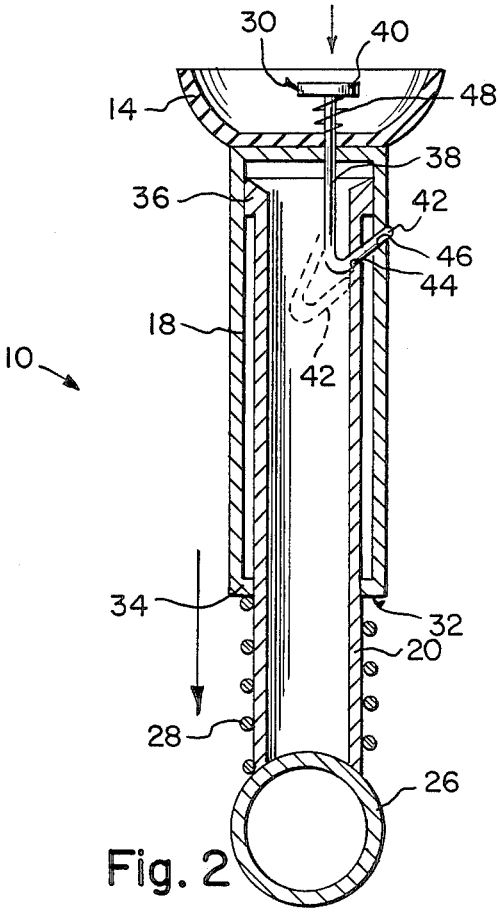
FIG. 2 is an enlarged cross sectional view taken along line 2—2 in FIG. 1 showing the release mechanism therein.

Turning now descriptively to the drawings, in which similar reference characters denote similar elements throughout the several views, FIGS. 1 and 2 illustrate an anti-choke releaser apparatus 10 for applying a sharp blow to upper abdomen 12 to aid in expulsion of an obstruction from the larynx of a choking victim. The apparatus 10 consists of an anchor 14 adapted to be secured to a planar surface 16. The anchor 14 is a suction cup for adhesive engagement with the planar surface 16. An elongated track member 18 is affixed at one end to the anchor 14. A slide member 20 is reciprocable within the track member 18. The track member 18 and the slide member 20 are formed as telescoping tubular elements. A hand grip 22 is affixed to the track member 18 for stabilizing and holding the apparatus 10. The handgrip includes handle bars 24 extending orthogonally from either side of the track member 18 in mutual axial alignment. A contact bar 26 is affixed transversely in its middle to end of the slide member 20 remote from the anchor 14.

An expansion spring 28 is positioned onto the slide member 20 between the track member 18 and the contact bar 26. A trigger mechanism 30 within the track member 18 is for holding the slide member 20 in its firing position. When the anchor 14 is secured to the planar surface 16 the trigger mechanism 30 will release the slide member 20 in which the expansion spring 28 will send the contact bar 26 outwardly for applying the sharp blow to the upper abdomen.

The apparatus 10 further includes a retention member 32 that consists of an inwardly extending stop flange 34 on remote end of the track member 18 and an outwardly extending stop flange 36 on remote end of the slide member 20 for preventing disengagement of the slide member from the track member.

The trigger mechanism 30 includes a flexible arm 38 having a head 40 at one end and a hook 42 at other end. The hook 42 of the arm 38 extends into the track member 18 so as to engage with angular holes 44, 46 through the slide member 20 and the track member 18 when the slide member is pushed upwardly into the track member with the head 40 extending into the suction cup 14. A smell return spring 48 is placed onto the flexible arm 38 between the head 40 and the suction cup 14 whereby when the suction cup is placed in the adhesive engagement with the planar surface 16, the head 40 will go down and compress the small return spring 48, thus releasing the hook 42 from the angular holes 44, 46 allowing the compression spring 28 to expand to push outwardly the slide member 20 and the contact bar 26.

Figure 3:
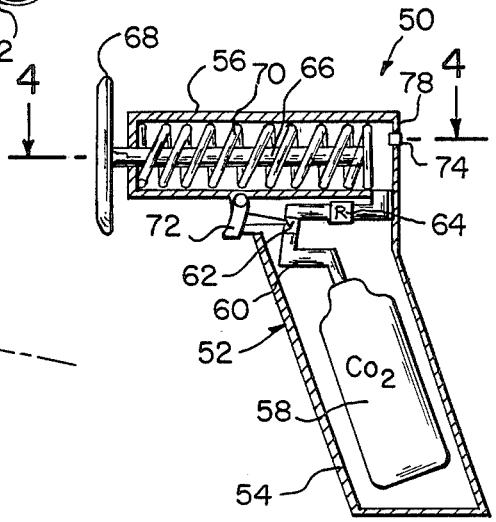
FIG. 3 is an elevational cross sectional view of a modification being a gun type system.
Figure 4:
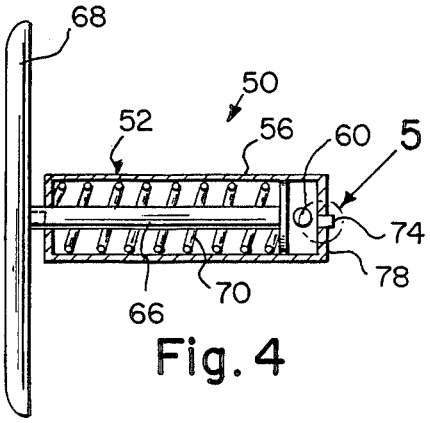
FIG. 4 is a cross sectional view taken along line 4—4 in FIG. 1 through the piston.

FIGS. 3 and 4 show another type of anti-choke releaser apparatus 50 containing a housing 52 that has a hollow handle 54 and a cylindrical chamber 56. A $CO_2$ gas cartridge 58 is placed into the hollow handle 54. A duct 60 that has a release valve 62 and regulator 64 therein extends from the cartridge 58 to the rear of the cylindrical chamber 56. A piston 66 extends through the cylindrical chamber 56 with the piston having an impact plate 68 on the external end thereof.

Figure 5:
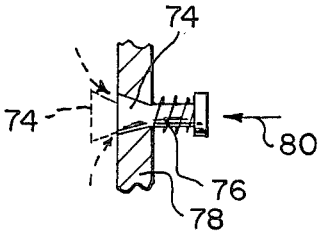
FIG. 5 is an enlarged detail view as indicated by numeral 5 in FIG. 4 showing the release valve in greater detail.

A return spring 70 is placed onto the piston 66 within the cylindrical chamber 56. A trigger 72 on the handle 54 is to open the release valve 62 to release $CO_2$ gas from the cartridge 58 through the regulator 64 and into the cylindrical chamber 56 to fire outwardly the piston 66. A relief valve 74 as best shown in FIG. 5 is normally spring biased outwardly to a closed position in rear wall 78 of the cylindrical chamber 56 remote from the impact plate 68. The relief valve 74 can be manually pushed inwardly, as indicated by arrow 80, to an open position to release the $CO_2$ gas from the cylindrical chamber 56 to allow the return spring 70 to push the piston 66 back to its original firing position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An anti-choke releaser apparatus for applying a sharp blow to upper abdomen to aid in expulsion of an obstruction in the larynx of a choking victim, said apparatus comprising:

(a) an anchor adapted to be secured to a planar surface;

(b) an elongated track member affixed at inner end to said anchor and having an outer remote end;

(c) a slide member reciprocable within said track member having outer and inner ends;

(d) a handgrip affixed to said track member for stabilizing and holding said apparatus;

(e) an impact member affixed to said slide member outer end;

(f) an expansion spring positioned on said slide member between said track member and engaging said contact bar; and (g) a trigger mechanism mounted in apparatus for holding said slide member in its firing position and releasing said slide member responsive to pressing said track member and anchor against said surface whereby said expansion spring will send said impact bar outwardly for applying a sharp blow to said upper abdomen.

2. An anti-choke releaser apparatus as recited in claim 1, wherein said track member and said slide member are formed as telescoping tubular elements, and wherein said anchor is a suction cup, further including a retention member comprising an inwardly extending stop flange on said remote end of said track member and an outwardly extending stop flange on remote end of said slide member for preventing disengagement of said slide member from said track member.

3. An anti-choke releaser apparatus as recited in claim 1, wherein said trigger mechanism includes:

(a) a flexible arm having a head at one end and a hook at the other end, said hook of said arm extending into said track member so as to engage with angular holes through said slide member and said track member when said slide member is pushed upwardly into said track member, said head extending into said suction cup; and (b) return spring placed onto said flexible arm between said head and said suction cup whereby when said suction cup is placed in said adhesive engagement with said planar surface, said head will go down and compress said small return spring thus releasing said hook from said angular holes allowing said compression spring to expand to push outwardly said slide member and said impact bar.

4. An anti choke apparatus for applying a sharp blow to the upper abdomen of the user of aid in the expulsion of food or other matter from the users larynx comprising:

(a) a housing having anchor means for restraining movement of said housing relative to a fixed structure;

(b) a slide reciprocally mounted in said housing;

(c) means for restraining said slide in a firing position and for automatically driving said slide member outward of said housing when said means for restraining said slide member is released and (d) trigger means for releasing said restraining means comprising a component mounted in said anchor and removeably connected to said slide responsive to application of pressure against said housing and anchor to release said slide.

* * * * *